United States Patent [19]

Croucher et al.

[11] Patent Number: 4,476,210

[45] Date of Patent: Oct. 9, 1984

[54] DYED STABILIZED LIQUID DEVELOPER AND METHOD FOR MAKING

[75] Inventors: Melvin D. Croucher, Oakville; James M. Duff, Mississauga; Michael L. Hair, Oakville; Kar P. Lok, Toronto; Raymond W. Wong, Mississauga, all of Canada

[73] Assignee: Xerox Corporation, Stamford, Conn.

[21] Appl. No.: 499,054

[22] Filed: May 27, 1983

[51] Int. Cl.[3] ..... G03G 9/12

[52] U.S. Cl. ..... 430/114; 430/115; 430/137

[58] Field of Search ..... 430/112, 113, 114, 115, 430/13 T

[56] References Cited

U.S. PATENT DOCUMENTS

| | | | |
|---|---|---|---|
| 3,542,681 | 11/1970 | Mutaffis | 252/62.1 |
| 3,554,946 | 1/1971 | Okuno et al. | 252/62.1 |
| 3,623,986 | 11/1971 | Machida et al. | 252/62.1 |
| 3,625,897 | 12/1971 | Machida | 252/62.1 |
| 3,890,240 | 1/1975 | Hockberg | 252/62.1 |
| 3,900,412 | 8/1975 | Kosel | 252/62.1 |
| 3,976,583 | 8/1976 | Herrmann et al. | 252/62.1 |
| 4,058,470 | 11/1977 | Moschovis et al. | 252/62.1 |
| 4,081,391 | 3/1978 | Tsubuko et al. | 252/62.1 |
| 4,087,393 | 5/1978 | Tsubuko et al. | 260/27 R |

*Primary Examiner*—John E. Kittle
*Assistant Examiner*—John L. Goodrow

[57] ABSTRACT

A stable colored liquid developer and method for making such are described wherein an improved optical density resulting from a colored dye being imbibed into a thermoplastic resin core occurs. In particular, the liquid developer comprises a marking particle dispersed in an aliphatic dispersion medium, the marking particle comprises a thermoplastic resin core having an amphipathic block or graft copolymeric steric stabilizer irreversibly chemically or physically anchored to the thermoplastic resin core with the dye being imbibed in the resin core and being soluble therein and insoluble in the dispersion medium. The stable colored liquid developer is preferably made by first preparing a graft or block copolymer amphipathic steric stabilizer, anchoring said stabilizer to a thermoplastic resin core, and to the aliphatic disperion of said particle adding a solution of a dye dissolved in a polar solvent, preferrably methanol, the dye being soluble in the thermoplastic resin core to enable it to be imbibed therein and substantially insoluble in the dispersion medium.

26 Claims, No Drawings

DYED STABILIZED LIQUID DEVELOPER AND METHOD FOR MAKING

BACKGROUND OF THE INVENTION

The present invention relates generally to liquid developers and methods of making liquid developers for use in electrostatographic reproducing systems. In particular, the present invention is directed to a liquid developer and a method for making the liquid developer which employs a novel marking particle, and specifically one which is of improved colored density with excellent shelf life stability and good fixing characteristics.

In the electrostatographic reproducing process in most common commercial use today, xerography, a light image of an original to be copied is typically recorded in the form of an electrostatic latent image upon a photosensitive member. The electrostatic latent image may be rendered visible by the application of electroscopic marking particles, referred to in the art as toner. The toner image can be either fixed directly upon the photosensitive member or transferred from the member to another support such as a sheet of plain paper with subsequent affixing of the image thereto.

An alternative development technique to that described above involves the use of a liquid developer or liquid toner. The conventional commercial liquid toners in present use in automatic office reproducing machines generally constitute a dispersion of pigments in a liquid hydrocarbon. Once the electrostatic latent image is formed, which is typically on a single use sheet of photoconductive paper, such as zinc oxide, it is transported through a bath of the liquid developer. When in contact with the liquid developers, the charged pigment particles in the liquid developer migrate through the liquid to the sheet in the configuration of charged image on the imaging sheet. The sheet may then be withdrawn from the liquid developer bath with the charged particles adhering to the electrostatic latent image in image configuration and a thin film of the residual developer remaining on the surface of the paper being evaporated within a few seconds. If desired, the marking particles may be fixed to the sheet in an image configuration.

Liquid toners of the present invention however are not to be understood to be limited to field of application in the xerographic process. They may, for example, be used in a variety of reproduction process including among others, electrographic recording, electrostatic printing, and facsimile printing. Accordingly, it should be appreciated that the description which herein follows is applicable to liquid developers in general, which may have utility in a variety of commercial embodiments.

As mentioned above, the liquid developers presented a first alternative to dry toner development of electrostatic latent images in automatic reproducing machines. In their earliest application they took the form of a pigment, such as carbon black, which would be dispersed in a petroleum distillate and have a charge applied thereto with a charge control agent such as a metal soap. The problem with the earliest liquid developers existed in their dispersion stability in that upon being stored for any extensive period of time, the carbon black pigment would tend to settle out of the dispersion medium and flocculate into nonredispersable macroscopic material at the bottom of the vessel. In an attempt to overcome this difficulty, a dispersant such as polyisobutylene which was soluble in the carrier liquid and which would be adsorbed on the carbon black pigment particles, was added in an attempt to provide a steric barrier between the individual particles. In effect, this was an attempt to provide increased dispersion stability by increasing the repulsive interaction between the individual carbon black particles, and to provide a more uniform dispersion so that the particles would not settle out. it was believed that the presence of the resin maintained the carbon black as discrete particles over long periods of time by providing a protective coating for the carbon black particles so that the attractive forces between adjacent particles would not come into play. While this was a dramatic improvement over the liquid developers without a dispersant that had been used heretofore, they suffered the difficulty in that the resin coating in some instances intended to desorb from the carbon black particles thereby permitting the attractive forces between adjacent particles to once again come into play. This resulted in the individual carbon black particles flocculating and settling to the bottom of the dispersion vessel.

The next step in the evolution of the development of liquid developers involved the use of amphipathic copolymers. For example, instead of the polyisobutylene homopolymer dispersant above which was soluble in most of the aliphatic hydrocarbons that were used as dispersion vehicles and which also coated the carbon black, an amphipathic copolymer which could be a block or graft copolymer was prepared on the theory that part of the copolymer would have an affinity for the liquid phase, the hydrocarbon liquid, and part of the copolymer would have an affinity for the surface of the individual pigment particles. Thus with the use of such an amphipathic copolymer, the part of the copolymer that wants to separate is adsorbed on the carbon black particle surface and binds the soluble part of the polymer to the particle surface thereby reducing the desorption of the polymer from the carbon black particles. Typical such approaches are those described in U.S. Pat. Nos. 3,554,946 (Okuno et al.), 3,623,986 (Machida et al.) and 3,890,240 (Hockberg). Even with this improvement in liquid developers, the dispersion stability continues to remain a problem, in that it was always possible that the stabilizer will be desorbed from the particle surface rendering the developer thermodynamically unstable.

The next event in the development of liquid developers involved trying to make a developer wherein desorption of the dispersant was in effect theoretically impossible. It was believed that a stable liquid developer would be provided if the particle contained a steric barrier which could not be desorbed from the particle surface. This of course is very difficult to do in the chemical sense when one is dealing with a carbon black pigment. The way around this particular difficulty however is to chemically make a particle wherein the steric barrier is chemically tied to the particle surface. This is typically done with a non-aqueous dispersion of polymer particles wherein a steric barrier is attached to the polymer surface thereby providing a thermodynamically stable polymer particle. This provides a liquid developer wherein the individual marking particles do not flocculate.

PRIOR ART

The above described non-aqueous dispersion of polymer particles with a steric barrier attached to the polymer surface is described in detail in U.S. Pat. No. 3,900,412 (Kosel) which is hereby incorporated in its entirety into the instant specification. Briefly Kosel shows the concept of chemically providing a stable developer by providing a polymer core with a steric barrier attached to the polymer surface. The problem that exists with the technique described by Kosel relates to providing a sufficient amount of colorant associated with the marking particle to provide suitable or acceptable optical density in the developed image. Beginning at column 15 of the Kosel patent, a discussion relates to imparting color by either using pigments or dyes and physically dispersing them as by ballmilling or high shear mixing. We have attempted to impart color by ballmilling pigments added to the latex without successfully obtaining a developed image of acceptable optical density. This is because the preferred size of latex particles are 0.2 to 0.3 microns in diameter and with ballmilling techniques it is very difficult to provide a dispersion of carbon black or other pigment particles much smaller in size than about 0.7 to about 0.8 microns. Consequently, the addition of carbon black pigment particles, for example, to the relatively small latex particles, for example, while ballmilling, would only result in the relatively small latex particles residing on the surface of the pigment particles.

At column 16 of Kosel, discussion with regard to the use of dyes as distinguished from pigments in providing suitable color to the liquid developer is presented. While this technique does work to a certain degree, it is still not possible to provide sufficient dye in the particle to give an image of acceptable optical density. Furthermore, and more importantly using this approach will increase the level of background deposits since all the dyes indicated at column 16 or indicated in the Kosel patent to be capable of use in this technique are soluble in the dispersion medium. Since as described above the liquid development technique involves substantially uniform contact of the imaging surface with the liquid developer including the insulating carrier fluid, this fluid must come in contact with the paper or copy sheet and the dye can readily be adsorbed onto the paper giving rise to increased background deposits in the final copy. This is unacceptable and accordingly further improvement is desired.

SUMMARY OF THE INVENTION

Accordingly it is an object of the present invention to provide an improved liquid developer.

It is a further object of the present invention to provide a new method of imparting color to a liquid developer.

It is a further object of the present invention to provide a colored liquid developer of substantially improved color characteristics and optical density.

It is a further object of the present invention to provide a liquid developer with increased colorant loading of the developer.

It is a further object of the present invention to provide a liquid developer with improved fixing characteristics to paper and to transparent film.

It is a further object of the present invention to provide a liquid developer which provides a substantially reduced level of background deposits of marking material.

It is a further object of the present invention to provide a liquid developer with improved dispersion stability of the marking particles.

It is a further object of the present invention to provide a method for imbibing the dye directly into the core of a thermoplastic marking particle.

It is a further object of the present invention to provide a liquid developer with a marking particle comprising a colorant molecularly dissolved in the core.

The above objects and others are accomplished in accordance with the present invention wherein a stable colored liquid developer and a method for making the same are provided. In particular, the stable colored liquid developer according to the present invention comprises an insulating liquid dispersion medium having dispersed therein colored marking particles which comprise a thermoplastic resin core which is substantially insoluble in the dispersion medium, and chemically or physically anchored to the resin core an amphipathic block or graft copolymer steric stabilizer which is soluble in the dispersion medium and further comprising a colored dye imbibed in the thermoplastic resin core, the colored dye dispersible at the molecular level and therefore soluble in the thermoplastic resin core and insoluble in the dispersion medium. In a preferred application, the dispersion medium is an aliphatic hydrocarbon, the amphipathic steric stabilizer is a graft copolymer of poly(2-ethylhexyl methacrylate) or poly(2-ethylhexyl acrylate) solution grafted with vinyl acetate, N-vinyl-2-pyrrolidone or ethyl acrylate and the thermoplastic resin core is a homopolymer or copolymer of vinyl acetate, N-vinyl-2-pyrrolidone or ethyl acrylate.

The stable colored liquid developers according to the present invention are made by providing an insulating dispersion medium of a marking particle comprising a thermoplastic resin core which is substantially insoluble in the dispersion medium, having physically or chemically anchored thereto an amphipathic steric stabilizer and adding thereto a solution of a desired dye dissolved in a polar solvent, the dye being soluble in the thermoplastic resin core to enable the dye to be imbibed in said resin core and substantially insoluble in the dispersion medium. The thermoplastic resin core is soluble in or swellable by the polar solvent. In a preferred method of making a stable colored liquid developer, an amphipathic block or graft copolymer steric stabilizer is prepared in an aliphatic dispersion medium in the presence of free radical initiator, an excess of a monomer or mixture of monomers which when polymerized will provide a thermoplastic resin core insoluble in the dispersion medium is added to the dispersion medium wherein said monomer or mixture of monomers are polymerized to provide a particle comprising a thermoplastic resin core substantially insoluble in a dispersion medium with an amphipathic branched steric stabilizer irreversibly chemically or physically anchored to the core. A solution of the desired dye in methanol preferably is added to the dispersion for the dye to be imbibed in the thermoplastic resin core.

An essential aspect of the invention consists of providing a liquid developer wherein the marking particles are highly colored and are stable in a liquid dispersion medium. Moreover the color is provided by a dye which is intimately bound to the thermoplastic resin core of a marking particle. This is to be contrasted to almost all of the liquid developers existing in the prior art which are based on a relatively large pigment particle being dispersed in the carrier liquid (dispersion medium). Further since the marking particle per se is a thermoplastic resin formed by in situ polymerization its particle size and its thermomechanical properties may be more uniformly controlled. A further aspect of the invention relates to providing a sterically stabilized marking particle. The above aspects and others are achieved with the use of nonaqueous dispersion polymerization techniques as well as a novel method for dye imbibition into a thermoplastic resin particle which involves the addition of a dye solution in a polar solvent to a nonaqueous dispersion of a sterically stabilized thermoplastic resin particle with the dye dispersible at the molecular level and therefore soluble in the thermoplastic resin and insoluble in the nonaqueous medium.

DESCRIPTION OF THE PREFERRED EMBODIMENT

The liquid developer is basically a latex in that it constitutes a colloidal suspension of a synthetic resin in a liquid. In particular it includes a continuous liquid phase (the dispersion medium) together with a dispersed phase (the dyed sterically stabilized thermoplastic resin particle).

For discussion of further details of the present invention it may be helpful to define certain terms which may be repeatedly used. By the term "sterically stabilized" we intend to define a particle that will remain dispersed in the dispersion medium by virtue of the attractive forces between adjacent polymer particles in the dispersion medium being screened by the steric stabilizer on the polymer particles. This steric stabilizer creates its own repulsive interaction between polymer particles which maintains them separated from each other. The steric stabilizer may be described as being amphipathic in nature by which we mean a portion of it has an affinity for one material and another portion has an affinity for another material. In our specific embodiment the amphipathic stabilizer has a moiety which is solvated by (soluble in) the dispersing liquid and a moiety which is nonsolvated by (insoluble in) the dispersing liquid. In our preferred stabilizer the moiety which is solvated by the dispersion liquid is a poly(alkyl acrylate) or poly(alkyl methacrylate) the alkyl group having at least three carbon atoms such as poly(2-ethyl hexyl acrylate) or poly(2-ethyl hexyl methacrylate) and the moiety which is nonsaturated by the dispension medium is poly(N-vinyl-2-pyrrolidone, poly(vinyl acetate) or poly(ethyl acrylate). The part of the stabilizer soluble in the dispersion medium forms a protective barrier around the particle while the nonsolvated moiety is absorbed or incorporated into the thermoplastic resin core thereby anchoring the solvated moiety to the resin core. As previously indicated the dye is "imbibed" into the resin core by which we contend that the dye is assimilated, bound up or absorbed by the resin core.

The liquid developers may be made with any suitable dispersion medium. Typically the dispersion medium is insulating having a resistivity greater than about $10^9$ ohm cm and a dielectric constant less than 3.5 so that it will not discharge the electrostatic latent image,. In addition, it typically has a viscosity less than about 2.5 centipoise so that the marking particles may readily move through it. It should have a relatively rapid evaporation rate such that a thin film will develop in 2 to 3 seconds. Typical dispersion media are colorless, odorless, nontoxic, and nonflammable having flash points greater than 104° F. and include aliphatic hydrocarbons it being noted that the aromatic liquids are generally not suitable because of their toxicological properties. A particularly preferred group of materials are many of the petroleum distillates commercially available on the market today. Typical of such preferred materials are Isopar G, Isopar H, Isopar K and Isopar L available from Exxon. Also included in this group are Amsco 460 Solvent, Amsco OMS, available from American Mineral Spirits Company. In addition, Phillips Petroleum's Soltrol, Mobil Oil's Pagasol and Shell Oil's Shellsol may be used.

The marking particle which is dispersed in the dispersion medium in the practice of the present invention comprises a synthetic resin core which is insoluble in the dispersion liquid and which has irreversibly anchored a solvated steric barrier or stabilizer by which we mean that the steric stabilizer is attached or bound either physically or chemically to the synthetic resin core such that it cannot leave the synthetic resin core. In addition the marking particle has a colored dye imbibed into it and preferably a charge control agent present on its surface.

The marking particles are preferably essentially monodispersed by which we mean that they are generally about the same size and shape having a relatively narrow size distribution. The nonaqueous dispersion polymerization process by which the particles are made provides for a well controlled particle size distribution. Typically the size of the particle is of the order of about 0.4 microns although the size range may be as broad as 0.1 to 1.0 microns as determined from transmission electron micrographics and using a Coulter Nanosizer. The monodispersed nature is preferred in providing substantially uniform charge on each particle or uniform charge to mass ratio of the developer and thereby insuring more accurate response of the charged marking particles to the electrostatic latent image.

Any suitable thermoplastic resin may be used as the core of the marking particle. Typical resins include materials which are capable of nonaqueous dispersion polymerization as hereinafter described, are insoluble in the dispersion medium, and include poly(methyl acrylate), poly(methyl methacrylate), poly(ethyl, methacrylate), poly(hydroxyethyl methacrylate), poly(2-ethoxyethyl methacrylate), poly(butoxy ethoxy ethyl methacrylate), poly(dimethyl amino ethyl methacrylate), poly(acrylic acid), poly(methacrylic acid), poly(acrylanide), poly(methacrylamide), poly(acrylonitrile), poly(vinyl chloride) and poly(ureido-ethyl vinyl ether). A preferred group of materials are the homopolymers of vinyl acetate, N-vinyl-2-pyrrolidone, ethyl acrylate monomers or copolymers of any of said monomers. The mechanical properties of the particle can be altered or varied by the selection of the polymer used for the core of the particle. For example, using poly(vinyl pyrrolidone) as the core polymer gives a hard particle which retains its spherical shape on drying. On the other hand poly(ethyl acrylate) particles coalesce on drying to form a film. This enables either opaque or transparent developers to be prepared and allows control of the thermomechanical properties that are essential for both transfer and direct liquid development.

The amphipathic stabilizer which is irreversibly anchored to the synthetic resin core may be of any suitable material. Typically it involves a graft or block copolymer having a moiety with an affinity for or being solvated by the dispersion medium and having another moiety having an affinity for the synthetic resin core. Preferably the amphipathic stabilizer has a molecular weight in the range of from about 10,000 to about 100,000. Lower molecular weights i.e., less than about 10,000 generally provide an insufficient steric barrier for the core particles which will still tend to flocculate while molecular weights above about 100,000 are usually unnecessary and uneconomical. Preferably the amphipathic polymer comprises a soluble polymer backbone having a nominally insoluble anchoring chain grafted onto the backbone. Alternatively the steric stabilizer may comprise an AB or ABA type block copolymer. Typical block copolymers include, poly(vinyl acetate-b-dimethyl siloxane), poly(styrene-b-dimethyl siloxane), poly(methyl methacrylate-b-dimethylsiloxane), poly(vinyl acetate-b-isobutylene), poly(vinyl acetate-b-2-ethyl hexyl methacrylate), poly(styrene-b-2-ethyl hexyl methacrylate), poly(ethyl methacrylate-b-2-ethyl hexyl methacrylate), and poly(dimethylsiloxane-styrene-dimethylsiloxane).

Typical polymers suggested for use as the soluble backbone portion of the graft copolymer upon which a second polymer may be grafted include polyisobutylene; polydimethylsiloxane; poly(vinyl toluene); poly(12-hydroxy stearic acid); poly(iso bornyl methacrylate); acrylic and methacrylic polymers of long chain esters of acrylic and methacrylic acid such as stearyl, lauryl, octyl, hexyl, 2-ethyl hexyl; polymeric vinyl esters of long chain acids such as vinyl stearate; vinyl laurate; vinyl palmitate; polymeric vinyl alkyl ethers including poly(vinyl ethyl ether); poly(vinyl isopropyl ether); poly(vinyl isobutyl ether); poly(vinyl n-butyl ether); and copolymers of the above.

Preferred backbone polymers include polyisobutylene, poly dimethylsiloxane, poly(2-ethylhexyl acrylate), poly(2-ethylhexyl methacrylate).

Typical monomers suggested for use as the insoluble portion of the graft copolymer include vinyl acetate, methyl acrylate, methyl methacrylate, ethyl acrylate, ethyl methacrylate, hydroxy ethyl acrylate, hydroxy ethyl methacrylate, acrylonitrile, acrylamide, methacrylonitrile, methacrylamide, acrylic acid, methacrylic acid, mono-ethyl maleate, monoethyl fumarate, styrene, maleic anhydride, maleic acid and N-vinyl-2-pyrrolidone. Preferred materials include vinyl acetate, N-vinyl-2-pyrrolidone and ethyl acrylate, because they are nontoxic, inexpensive and readily grafted onto a variety of soluble backbone polymers and provide excellent anchoring to the core particle. While as noted above the synthetic resin core must be insoluble in the dispersion liquid the backbone moiety of the amphipathic stabilizer is soluble in the dispersion liquid and imparts colloidal stability to the particle.

The marking particle may be colored with any suitable dye to impart color to it. The dye is preferably dispersible at the molecular level in the synthetic resin core to provide a molecular dispersion and insure good distribution since otherwise it will tend to aggregate and give poor color intensity as well as broadened spectral characteristics. Furthermore the dye should be insoluble in the carrier liquid so that once it is imbibed into the resin core it will not diffuse out into the dispersion medium. In addition being insoluble in the dispersion medium insures that background deposits will be minimized since as noted above, during development of an electrostatic latent image the entire imaging surface may be contacted with the liquid developer and if the dye is insoluble in the liquid phase, it cannot deposit as background. Furthermore it is preferred that the dye be water insoluble to insure permanence of the developed image. Otherwise following development of an image if it were to come in contact with water as may frequently be the case in an office environment with coffee, tea, etc., the image would instantaneously dissolve. Typical dyes that may be used include Orasol Blue GN, Orasol Red 2BL, Orasol Blue BLN, Orasol Black CN, Orasol Yellow 2RLN, Orasol Red 2B, Orasol Blue 2GLN, Orasol Yellow 2GLN, Orasol Red G, available from Ciba Geigy, Mississauga, Ontario, Canada, Morfast Blue 100, Morfast Red 101, Morfast Red 104, Morfast Yellow 102, Morfast Black 101 available from Morton Chemicals Ltd; Ajax, Ontario, Canada and Savinyl Yellow RLS, Savinyl Pink 6BLS, Savinyl Red 3BLS, Savinyl Red GL5 available from Sandoz, Mississauga, Ontario, Canada.

The liquid developer preferably includes a charge control agent to give the particle charge in order for it to undergo electrophoresis in an electric field. Any suitable such agent selected from the well known agents for such purpose may be used. Useful charge control agents include the lithum, cadmium, calcium, manganese, magnesium and zinc salts of heptanoic acid. The barium, aluminum, cobalt, manganese, zinc, cerium and zirconium salts of 2-ethyl hexanoic acid. (These are known as metal octoates). The barium, aliuminum, zinc, copper lead and iron salts of stearic acid. The calcium, copper, manganese, nickel, zinc and iron salts of naphthenic acid. Ammonium lauryl sulfate, sodium dihexyl sulfosuccinate, sodium dioctyl sulfosuccinate, aluminum diisopropyl salicylate, aluminum dresinate, aluminum salt of 3,5di-t-butyl gamma resorcylic acid. Mixtures of these materials may also be used. A preferred material for our purposes is zirconium octoate which is soluble in our preferred dispersion liquid, and provides a positive charge on the synthetic resin particles.

The liquid developers of the present invention may be made by any suitable technique. However, we have found a rather unique procedure for producing the stabilized highly colored liquid developers. Essentially our procedure involves first preparing the amphipathic stabilizer in the liquid developer dispersion medium followed by adding in the presence of a free radical initiator an excess of a monomer or a mixture of monomers from which the synthetic resin core is to be made, followed by polymerizing the monomer to form the synthetic resin. Thereafter a solution of the dye or mixture of dyes in a polar solvent or mixture of polar solvents is added to the dispersion to imbibe the dye in the core of the marking particle.

During the polymerization procedure the amphipathic stabilizer becomes intimately bound to the synthetic resin core. By intimately bound we intend to define those chemical as well as physical interactions that irreversibly anchor the amphipathic stabilizer in such a way that it cannot leave the particle under normal operating conditions. Once the stabilized resin core has been made, the dye may be imbibed in it according to the novel technique of the present invention hereinafter described and the charge control agent may be added to the dispersion. This procedure may be viewed as a four step procedure involving;

(A) preparation of the amphipathic stabilizer, (B) nonaqueous dispersion polymerization of the core monomer in the presence of the amphipathic stabilizer to provide the stabilized particle, (C) dyeing of the nonaqueous dispersion particles, and (D) charging the particles.

The amphipathic stabilizer may be either a block or graft copolymer formed by adding the selected monomers to a solution in the insulating dispersion medium of the backbone polymer. For example, to a solution of poly(2-ethylhexyl methacrylate) in Isopar G, vinyl acetate, N-vinyl-2-pyrrolidone or ethyl acrylate or a mixture of these monomers may be added. The reaction is carried out in the presence of a free radical initiator such as benzoyl peroxide or azo bis isobutyronitrile at atmospheric pressure and elevated temperature of from about 60° C. to about 90° C. for about five hours. The product is a graft copolymer. The graft copolymer stabilizer typically comprises the polymer backbone having grafted to it at various positions along its chain, a polymer or copolymer of one or more of the added monomers.

Once the stabilizer in the dispersion medium has been prepared the synthetic resin core may be made by nonaqueous dispersion polymerization. This is accomplished by adding an excess of a monomer to be polymerized to the solution containing the amphipathic stabilizer which acts as the steric stabilizer during the growth of the polymer particles. This growth takes place in the presence of a free radical initiator at atmospheric pressure and elevated temperatures of from about 60° C.-90° C. Over a period of several hours, 8 to 20 hours, the polymer core of the marking particle is grown in the presence of the steric stabilizer with the result that a dispersion of up to about 50% by weight of particles having a relatively uniform size within the range of from about 0.1 to about 1.0 micron with most of the particles being in the 0.3 to 0.4 micron size range. During the growth of the polymer core the amphipathic polymer functions as a steric stabilizer to keep the individual growing particles separate in the dispersion. If for example, the dispersion polymerization of the core monomer takes place without the stabilizer the polymer formed from the monomer will phase separate forming the nucleus of the particle which will then flocculate and sediment as an aggregate. Instead, the polymerization takes place in the presence of the stabilizer which as previously discussed becomes irreversibly intimately bound either chemically or physically to the polymer core being formed thereby providing a thermodynamically stable particle.

Once the stable dispersion of marking particles has been prepared it is dyed according to the novel technique of the present invention to provide a core particle capable of producing a toned image of good optical density and color characteristic. The dye is molecularly incorporated into the core particles by using a specific dye imbibition absorption technique. We have found that polar solvents may be specifically absorbed into the core of the particle produced from the nonaqueous dispersion polymerization procedure and by dissolving a dye into such a polar solvent the dye is readily imbibed or absorbed into the polymer core. The polar solvent used should be essentially insoluble in the dispersion medium otherwise some of the dye may go into the dispersion medium increasing the possibility of deposition in background areas. Any polar solvent which is absorbed into the core of the marking particle may be used. We have found that methanol, glacial acetic acid, ethylene glycol, dimethyl sulfoxide and N,N-dimethyl formamide and mixtures of these solvents perform well. We prefer to use methanol as the solvent for the dye since it may be desirable, if not necessary in some instances, to remove the polar absorption fluid from the particles and the methanol can be readily removed by simple heating or distillation. Of course other suitable techniques may be used to remove the polar solvent from the particles.

The dyes used should be highly soluble in the polar solvent and insoluble in the dispersion medium. Typical dyes selected from those previously mentioned include Orasol Blue GN, Orasol Blue 2GLN, Orasol Yellow 2GLN, Orasol Red G, Morfast Blue 100, Morfast Red 101, Morfast Red 104, Morfast Yellow 102. Typically from about 5% to about 25%, preferably 10% weight-/volume solution of the dye is prepared and added drop wise to the dispersion containing from about 2% to about 10% by weight of marking particles. This imbibition procedure is carried out at elevated temperatures of from about 40° C. to about 60° C. until an acceptable amount of dye has been imbibed or absorbed by the core particles. Typically this can take from about 4 to about 16 hours depending on the dye, the type of core particle and the temperature. We have found that this technique is capable of providing stable colored marking particles yielding developed or toned images of superior optical density and color characteristics. After the dye imbibition procedure the polar solvent, particularly if it is methanol, may be removed by distillation thereby imparting somewhat better image and fixing properties. The concentrate so prepared may then be diluted to from about 0.2 to about 0.6% by weight of particles by adding more dispersion medium.

In order for the dyed particles to develop an electrostatic latent image they must be charged (positive or negative) depending on end use application. This may be achieved by the addition of a suitable charge control agent in conventional manner. Typically an agent such as a soap of a heavy metal is added to the dispersion which dissociates in the dispersion medium with the heavy metal ion being absorbed at the particle, liquid interface. The charge control agent may be selected from a long and well know list. Typically materials include those materials previously mentioned. As previously indicated we prefer zirconium octoate because it provides a superior positive charge. Typically from about 0.01% to about 0.1% weight/volume of charge control agent is used. The amount of charge control agent added is dependent upon the charge/mass ratio desired for the liquid developer which typically can range from less than 10 microcoulombs per gram to greater than 2,000 microcoulombs per gram.

The liquid developers of the present invention may comprise the various constituents in a variety of suitable proportions depending on the ultimate end use. While the developers may have a solid content of from 0.1-2.0% weight/volume typically from about 0.2%-0.5% weight/volume of particles are present in the dispersion medium. Each particle comprises from about 50% to about 98% by weight of the polymer core and from about 50% to about 2% by weight of amphipathic stabilizer. The polymer core typically contains from about 5% to about 30% by weight of the dye and the charge control agent is present in conventional amounts of from about 19% to about 5% by weight of particles to provide a charge/mass ratio of from 10 to in excess of 2,000 microcoulombs per gram depending upon the application for which it is to be used.

EXAMPLES ACCORDING TO THE INVENTION

The invention will now be described with reference to the following specific examples. Unless otherwise indicated all parts and percentages are by weight.

A. Preparation of Amphipathic Steric Stabilizer (1) Preparation of Poly(isobutylene-g-vinyl acetate)

30 gms of polyisobutylene were dissolved in 500 ml of Isopar G. The solution was heated to 75° C. and purged with nitrogen for 30 min. 5 ml of vinyl acetate and 0.75 gms of benzoyl peroxide were added to this solution and the polymerization allowed to proceed for about 16 hours under constant stirring at 75° C. to obtain the amphipathic copolymer.

(2) Preparation of Poly(dimethylsiloxane-g-methyl methacrylate)

30 gms of polydimethylsiloxane were dissolved in 450 ml of Isopar G. The solution was heated to 75° C. and purged with nitrogen for 30 minutes. 0.5 gms of benzoyl peroxide was then added to this solution. After an interval of one hour 5 ml of methyl methacrylate was added. The graft polymerization was allowed to proceed under constant stirring at 75° C. for about 15 hours. A clear solution of the amphipathic copolymer was obtained.

(3) Preparation of Poly(12-hydroxystearic acid-g-glycidyl methacrylate)

300 gms 12-Hydroxystearic acid were heated with 60 ml xylene at 190° C. under nitrogen. Water was removed by azeotropic distillation. Heating was continued for 24 hours and a total of about 15 ml water was collected. After evaporation of the xylene the terminal carboxyl groups of the resulting poly(12-hydroxystearic acid) (PHSA) were converted to methacrylate by heating of 50 gms of the PHSA with 6.0 gms glycidyl methacrylate in 100 ml xylene. 0.10 g N,N-dimethyllaurylamine was added as catalyst. A small amount of 0.05 gms hydroquinone was also added as a free radical inhibitor. Reaction was allowed to proceed at 140° C. for 16 hours under constant stirring.

(4) Preparation of Poly(2-ethylhexyl methacrylate-g-vinyl acetate)

75 ml of 2-ethylhexyl methacrylate were dissolved in 300 ml of Isopar G. The solution was heated to 75° C. and purged with nitrogen for about 30 minutes. 0.8 gms of AIBN (azobis-isobutyronitrile) were added to this solution and the polymerization allowed to proceed while being constantly stirred for about 16 hours at 75° C. to produce poly(2-ethylhexyl methacrylate).

375 ml of Isopar G was then added to 200 ml of the polymer solution formed which was heated to 75° C. while being purged with nitrogen. 1 gm of azobis-isobutyrolnitrile (AIBN) was then added to this solution. After heating for a further two hours, 10 ml of vinyl acetate was added to the solution and polymerization allowed to proceed at 70° C. under constant stirring for a further eight hours. A clear solution of the amphipathic copolymer was obtained.

(5) Preparation of poly(2-ethylhexyl methacrylate-g-N-vinyl-2-pyrrolidone)

500 ml of Isopar G was added to 200 ml of poly(2-ethylhexyl methacrylate) prepared as described in example A4. The solution was heated to 75° C. and purged with nitrogen for 30 minutes. 0.3 gms of benzoyl peroxide was added to this solution. After heating for a further 2 hours 2.0 ml of vinyl pyrrolidone was added to the solution and polymerization allowed to proceed at 70° C. for a further 16 hours. A clear solution was obtained.

(6) Preparation of poly(2-ethylhexyl acrylate-g-ethyl acrylate)

125 ml of 2-ethylhexylacrylate was dissolved in 500 ml of Isopar G. The solution was heated to 75° C. and purged with nitrogen for approximately 30 minutes. 1.6 gms of benzoyl peroxide was added to the solution and the polymerization allowed to proceed at 75° C. under constant stirring for about 16 hours. A solution of poly(2-ethylhexylacrylate) was obtained. 500 ml Isopar G was then added to 280 ml of this polymer solution, which was heated to 75° C. and purged with nitrogen for 30 minutes. 1.2 gms AIBN was then added to this solution. After heating for a further two hours 12 ml of ethyl acrylate was added to the solution and polymerization allowed to proceed at 75° C. for 16 hours. A clear graft copolymer solution was obtained.

(7) Preparation of poly(2-ethylhexyl acrylate-g-vinyl acetate)

240 ml of Isopar G was added to 75 ml poly(2-ethylhexylacrylate) prepared as in Example A6. The solution was heated to 75° C. and purged with nitrogen for 30 minutes. 0.4 gms of benzoyl peroxide was then added to this solution. After heating for a further 2 hours, 8 ml of vinyl acetate was added to the solution and polymerization allowed to proceed at 75° C. for a further 16 hours. A clear solution of the graft copolymer was obtained.

B. Nonaqueous Dispersion Polymerization of the Particle Core (1) Preparation of Poly(vinyl acetate) Latex Stabilized by Poly(isobutylene-g-vinyl acetate) amphipathic copolymer 500 ml of poly(isobutylene-g-vinyl acetate) dissolved in Isopar G as prepared in A1 above was heated to 80° C. while being purged with nitrogen for 30 minutes. 1.5 gms of benzoyl peroxide was added to this solution followed by 110 ml of vinyl acetate. After about 30 minutes at 80° C., the solution became opalescent. The reaction was allowed to proceed for a further 16 hours under constant stirring at about 60° C. after which a latex was obtained. The particles in the latex had a particle size of from about 0.2–0.6 microns in diameter as determined by electron microscopy. The solid content of the latex was adjusted to 4% weight/volume by the addition of 2.0 liters Isopar G.

(2) Preparation of poly(vinyl acetate) latex stabilized by the poly(2-ethylhexyl methacrylate-g-vinyl acetate) amphipathic copolymer 750 ml of the graft copolymer solution prepared in Example A4 was heated to 70° C. and purged with nitrogen for 30 minutes. 0.6 gms of AIBN was then added to the solution followed, after a further one hour, by 100 ml of vinyl acetate. The reaction was allowed to proceed at 70° C. for a further 16 hours under constant stirring. A latex 0.2–0.6 microns particle diameter was obtained as evidenced by electron miscroscopy. The solids content of the latex was adjusted to 4% weight volume by the addition of 1.7 liters of Isopar G.

(3) Preparation of poly(N-vinyl-2-pyrrolidone) latex stabilized by the poly(2-ethylhexyl methacrylate-g-N-vinyl-2-pyrrolidone) amphipathic copolymer 700 ml of the graft copolymer solution prepared in Example A5 was heated to 70° C. and purged with nitrogen for 30 minutes. 1.0 gms of AIBN was then added to this solution followed, after a further one hour, by 230 ml of N-vinyl-2-pyrrolidone. The reaction was allowed to proceed at 70° C. for a further 16 hours under constant stirring. A latex of 0.2–0.6 microns particle diameter was obtained as evidenced by electron microscopy. The solids content of the latex was adjusted to 4% weight/volume by the addition of about 4.5 liters of Isopar G.

(4) Preparation of poly(ethyl acrylate) latex stabilized by poly(2-ethylhexyl acrylate-g-ethyl acrylate) amphipathic copolymer 800 ml of the graft copolymer solution prepared in Example A6 was heated to 70° C. and purged with nitrogen for 30 minutes. 5 gms of AIBN was then added to the solution followed, after a further one hour, by 110 ml of ethyl acrylate. The reaction was allowed to proceed at 70° C. for a further 16 hours under constant stirring. A latex 0.2–0.6 microns in diameter was obtained as shown by electron microscopy. The solid content of the latex was adjusted to 4% weight/volume by the addition of about 1.7 liters of Isopar G.

(5) Preparation of poly(ethyl acrylate) latex stabilized by poly(ethylhexyl acrylate-g-vinyl acetate) amphipathic copolymer 300 ml of graft copolymer solution prepared in Example A7 was heated to 70° C. and purged with nitrogen for 30 minutes. 2.0 gms of benzoyl peroxide was then added to the solution followed, after a further one hours, by 60 ml of ethyl acrylate. The reaction was allowed to proceed at 70° C. for a further 16 hours under constant stirring. A latex 0.2–0.6 microns particle diameter was obtained as indicated by electron microscopy. The solids content of the latex was adjusted to 4% weight/volume by the addition of about 1.2 liters of Isopar G.

(6) Preparation of poly(vinyl acetate) latex stabilized by poly(ethylene-vinyl acetate) copolymer 10 gms of a poly(ethylene-vinyl acetate) copolymer containing 72% ethylene units (obtained from Polysciences Inc., Warington Pa.) was dissolved in 250 ml of Isopar G. The solution was heated to 75° C. and purged with nitrogen for about 30 minutes. 1.2 gms of benzoyl peroxide was added to the solution. After heating for a further two hours, 50 ml of vinyl acetate was added to the reaction vessel and polymerization allowed to proceed at 75° C. for 16 hours under constant stirring. 0.2–0.8 micron diameter latex particles were obtained as evidenced from electron microscopy. The solids content of the latex was adjusted to 4% weight/volume by the addition of 1 liter of Isopar G.

(7) Preparation of poly(vinyl acetate-co-N-vinyl-2-pyrrolidone) latex stabilized by poly(2-ethylhexyl methacrylate-g-vinyl acetate) amphipathic copolymer 130 ml of the graft copolymer solution prepared in Example A4 was heated to 70° C. and purged with nitrogen for 30 minutes. 0.25 gms of AIBN was then added to the solution followed, after a further one hour, by 40 ml of vinyl acetate. The reaction was allowed to proceed at 70° C. for a further 16 hours under constant stirring at which time 0.05 gms of AIBN was added to the dispersion followed, after a further one hour, by 7 ml of N-vinyl-2-pyrrolidone. The reaction was allowed to proced at 70° C. for a further 16 hours under constant stirring. A latex 0.2–0.6 microns particle diameter was obtained. The solids content of the latex was adjusted to 4% weight/volume by the addition of about 850 ml of Isopar G.

(8) Preparation of poly(vinyl acetate-co-ethyl acrylate-co-N-vinyl-2-pyrrolidone) latex stabilized by poly(2-ethylhexyl methacrylate-g-vinyl acetate) amphipathic copolymer 250 ml of the graft copolymer solution prepared in Example A4 was heated to 70° C. and purged with nitrogen for 30 minutes. 0.2 gms of AIBN was then added to the solution followed, after a further one hour, by 25 ml of vinyl acetate. The reaction was allowed to proceed at 70° C. for 5 hours after which 0.1 gms of AIBN was added to the solution followed by 15 ml of ethyl acrylate. The reaction was allowed to proceed at 70° C. for 16 hours at which time 0.05 gms of AIBN was added to the solution followed, after a further one hour, by 5 ml of N-vinyl-2-pyrrolidone. The reaction was allowed to proceed at 70° C. for a further 16 hours. The reaction mixture was continuously stirred throughout the reaction. A latex of 0.2–0.6 microns particle diameter was obtained as evidenced by electron microscopy. The solids content of the latex was adjusted to 4% weight/volume by the addition of about 875 mls of Isopar G.

(9) Preparation of poly(ethyl acrylate-co-N-vinyl-2-pyrrolidone) latex stabilized by poly(2-ethylhexyl acrylate-g-ethyl acrylate) amphipathic copolymer 800 of the graft copolymer solution prepared in Example A6 was heated to 70° C. and purged with nitrogen for 30 minutes. 5 gms of AIBN was then added to the constantly stirred solution followed, after a further one hour, by 110 ml of ethyl acrylate. The reaction was allowed to proceed at 70° C. for a further 16 hours. 2.5 gms of AIBN was then added to the dispersion, followed, after a further one hour by 40 ml of N-vinyl-2-pyrrolidone. The reaction was allowed to proceed at 70° C. for a further 16 hours while being constantly stirred. A latex 0.2–0.6 microns particle diameter was obtained as evidenced by electron microscopy. The solids content of the latex was adjusted to 4% weight/volume by the addition of about 3 liters of Isopar G.

C. Dyeing of the Latex

The solids content of each of the latices in the table below was adjusted to about 4% weight/volume by the addition of Isopar G to the dispersion dyes to be used as listed in the table. They were dissolved in the amounts indicated of absolute methanol and filtered through a Whatman No. 4 filter paper. In each example below the dyed methanol solution was added dropwise to the latex with constant stirring. The absorption process was carried out at 60° C. over a period of three hours after which the methanol was removed by distillation under pressure of 2 Torr and the resulting dyed latex filtered through glass wool to remove any unwanted material.

| Latex Code Number | Volume of 4% w/v latex used | Amount (gms of) dye used in 10 mls of methanol |
|---|---|---|
| B2-B9 each inclusive | 100 mls | a. 1 g ORASOL BLUE 2GLN |
| | | b. 1 g ORASOL RED G |
| | | c. 1 g ORASOL YELLOW 2GLN |
| | | d. 1 g ORASOL BLUE GN |
| B2 | 100 mls | e. 1 g ORASOL BLUE BLN |
| | | f. 1 g ORASOL BLACK CN |
| | | g. 1 g ORASOL BROWN CR |
| B3 | 100 mls | h. 2 g MORFAST BLUE 100 |
| | | i. 2 g MORFAST RED 101 |
| | | j. 2 g MORFAST RED 104 |
| | | k. 2 g MORFAST YELLOW 102 |
| | | l. 1 g MORFAST BLACK 101 |
| | | m. 3 g MORFAST BLACK 108 |
| | | n. 1 g BISMARCK BROWN R(Aldrich) |
| | | o. 1 g NEOLAN BLUE (Ciba-Geigy) |
| B5 | | p. 2 g SAVINYL YELLOW RLS |
| | | q. 2 g SAVINYL BLACK RLS |
| | | r. 2 g SAVINYL RED 3 GLS |
| | | s. 2 g SAVINYL PINK 6BLS |
| Mixtures of dyes can also be used | | |
| B2 | 100 mls | 0.5 g ORASOL YELLOW 2GLN |
| | | 0.1 g ORASOL RED G |
| | | t. 0.3 g ORASOL BLUE BLN |
| | | 0.2 g ORASOL BLUE 2GLN |

This example provides a dark blue latex on dyeing.

Secondary colors can also be produced by *mixing* dyed latices together. For example

| | | |
|---|---|---|
| B9a | | 12.5 ml |
| B9b<br>B9c | B10 | 10.0 ml<br>10.0 ml |

this gives a black latex on mixing these latices in proportions indicated.

D. Preparation of the Liquid Developer 40 ml of each of the dyed latices prepared in C above were diluted with 280 mls of Isopar G to provide a dispersion with a solid content of 0.5% weight/volume. 0.5 ml of a 6% of 12% solution of zirconium octoate solution (Nuodex available from Nuodoex Canada, Toronto, Canada) was added to the latex to provide a positively charged developer material.

This dispersion was then used as a liquid developer to develop an electrostatic latent image in a Versatec V-80 Electrostatic Printer/Plotter using a variety of dielectric papers including those supplied by James River Graphics of Berlin, N.H., Crown Zellerbach of San Francisco, Calif. and Sihl, Zurich, Switzerland. The resulting images all had optical densities ranging from 0.7 to 1.5 as measured using a Macbeth TR 927 densitometer. Throughout these tests it was observed that the optical density of the image was a function of the development speed of the printer and the voltage applied by the writing head to the dielectric paper in that the slower the development speed and the higher the writing voltage, the higher the resulting optical density. The fixing of the image to paper was quantified using a Teledyne Taber Abraser (Model 503).

The images exhibited excellent waterfastness and could not be removed after soaking for 48 hours in a waterbath. The resulting images can be made either transparent or opaque depending upon the polymer(s) choosen to make the core of the particle. For instance, when the glass transition temperature $T_g$ of the core particle is lower than about 20° C., the developer will coalesce to form a film on imaging thus giving excellent transparency and outstanding fix to the paper. When the $T_g$ of the core particle is greater than about 20° C. the developer particles will retain their spherical shape on imaging to give an opaque image. Some representative results are listed in Table I below:

TABLE I

| Latex Code Number after Dyeing | Charge/Mass Ratio of Developer[2] ($\mu C\ g^{-1}$) | Optical Density of Images on Paper[3] | Water fastness[4] | Image Fix[5] Level | Comments |
|---|---|---|---|---|---|
| B2a | 740 | 1.1 | Excellent | Satisfactory | translucent image |
| B2b | 960 | 1.1 | Excellent | Satisfactory | translucent image |
| B2c | 700 | 0.9 | Excellent | Satisfactory | translucent image |
| B3a | 840 | 1.3 | Satisfactory | good | opaque image |
| B3b | 1180 | 1.3 | Satisfactory | good | opaque image |
| B3c | 780 | 1.1 | Satisfactory | good | opaque image |
| B4a | 620 | 1.1 | Excellent | Excellent | transparent image |
| B4b | 880 | 1.1 | Excellent | Excellent | transparent image |
| B4c | 620 | 0.9 | Excellent | Excellent | transparent image |
| B9a | 680 | 1.3 | Excellent | Excellent | transparent image |
| B9b | 1050 | 1.3 | Excellent | Excellent | transparent image |
| B9c | 620 | 1.2 | Excellent | Excellent | transparent image |
| B10 | 880 | 1.2 | Excellent | Excellent | opaque image |

1. These imaging tests were carried out on a Versatec V-80 Electrostatic Printer/Plotter using Crown-Zellerbach dielectric paper. The writing voltage was 700 v and the paper speed was 1 inch/sec.

2. The charge control agent used was a 12% solution of Nuodex.

3. Measured in reflection using a Macbeth TR927 densitometer.

4. This was measured by immersing the sample in a water bath at 45° C. for 48 hours and measuring the optical density of the image both before and after testing. An excellent rating indicates that there was no change in the optical density of the image after testing. A satisfactory rating indicates that the optical density decreased by about 25 to 50% on testing.

5. This was established by measuring the optical density of the image before testing and after subjecting the image to 20 cycles of the Taber abraser using a 1 kilogramme wheel. A rating of excellent means that there was no change in the optical density of the image after testing. Good indicates that the optical density decreased by no more than 25% on testing while satisfactory indicates that the optical density decreased by 25–50% on testing.

The liquid developers numbered B4*a, b, c,* and B9 *a, b, c* in Table I can also be developed on Versatec (Santa Clara, Calif.) dielectric film to give transparent images (they can be projected on an overhead projector) with excellent adhesion and waterfastness.

COMPARATIVE EXAMPLES

D.1. To 70 mls of a 20 w/v % sample of latex B3 was added 2 gms of Uhlich 8200 Carbon Black that had been attrited for 48 hours in 200 ml of Isopar G. This mixture was then attrited (Union Process 01 attritor) for 1½ hours at room temperature using the minimum stirring rate. 4 mls of this dispersion was then diluted with 100 mls of Isopar G and 0.5 ml of Zirconium Octoate (12% Nuodex) added to change the particles. The liquid developer was found to image on a Versatec 1200 printer/plotter to give an image of optical density 0.7–0.8. The image was poorly fixed to the paper and exhibited no rub-resistance. More importantly, the particle size of the toner was 1–2 microns in size and was found to coagulate upon standing.

D.2. Sample preparation was the same as example D1 except latex B2 was used in place of latex B3. The image obtained on the Versatec V-80 also had an optical density of 0.7–0.8. It exhibited satisfactory fix to paper. However, electron microscopy showed that the discrete nature of the latex particles was destroyed such that the toner coagulated very quickly and could not be redispersed.

D.3. 70 ml of a 20 w/v % sample of latex B2 was attrited slowly for 1 hour with 2 gms of Eastman Polyester Yellow which had been attrited in 200 mls of Isopar G for 20 hours. 4 mls of this dispersion was then diluted with 100 mls of Isopar G and 0.5 mls of 12% Zirconium Nuodex added to the dispersion to charge the particles. The liquid developer was found to give a yellow image on a Versatec 1200 printer/plotter. The optical density of the image was about 0.3 and the fix to paper was satisfactory.

D.4. The same procedure was used as in example D3 but with DuPont Latyl Brilliant Blue substituted for Eastman Polyester Yellow. The image obtained on the Versatec 1200 printer was found to have an optical density of 0.2 with satisfactory adhesion to paper.

D.5. The same procedure was used as in example D4 but with Amasolve Cervise P (American Cyanamid) used instead of Eastman Polyester Yellow. The optical density of the magenta image obtained from the Versatec 1200 plotter was 0.3. It was extremely "grainy" and exhibited poor adhesion to paper.

The following comparative examples use of dyeing technique suggested by U.S. Pat. No. 3,900,412 which rely on thermal imbibition of the dyes from the paraffinic dispersion medium.

D.6. 30 mls of a 20% w/v % sample of latex B2 was added to 1 grm of Sudan Black B dissolved in 30 ml of Isopar G. The solution was heated to 80° C. and stirred gently for 3 hours. After cooling, the dispersion was filtered through glass wool. 25 mls of this dispersion was then diluted with 600 mls of Isopar G and 1 ml of Zirconium octoate added to charge the particles. A blue image that was of low optical density, 0.3, was obtained using the Versatec 1200 plotter. In addition, the background image in these prints was unacceptably high. The toner exhibited both satisfactory fix to paper and was waterfast.

D.7. The same procedure and latex was used as in example D6 to prepare a LID toner. The dye used was Sudan Red 7B (Aldrich) instead of Sudan Black B. Since this dye was only sparingly soluble in Isopar G, before use, it was heated to 353K in order to dissolve it and then filtered through glass wool to remove the undissolved material. The toner prepared from this dye gave a red image using the Versatec 1200 plotter. The optical density of the image was only about 0.2. The fixing of the image and its waterfastness were found to be satisfactory.

D.8. The same latex, materials and procedure was used as in example D7 except that the dye used was Sudan Yellow 146 (BASF). The LID toner gave an image using the Versatec 1200 printer but its optical density was only about 0.2. It exhibited satisfactory fix and waterfastness to paper.

As may be seen from the above description of the liquid developer of the present invention together with its method of manufacture, a dye is deposited directly in the core of a thermoplastic resin particle. It does not react with the core or with the steric barrier, but rather is imbibed in the resin particle. Furthermore since the dye is soluble in the resin particle and insoluble in the dispersion medium, there is no dye present in the dispersion medium which can be offset into the background areas of any image to be developed. That the dye is imbibed directly into the particle was indeed a surprise to us in that one would expect the latex to be flocculated upon the addition of a polar solvent such as methanol in that methanol is a nonsolvent for the polymeric stabilizing moiety. Instead of that happening however, the latex remained stable and the dye was imbibed into the polymer. Thus with the choice of a core polymer that is soluble in the polar solvent, the imbibition of the dye into the core polymer is assured. In addition the liquid developer typically provides images having an optical density of from 0.7 to about 1.5 depending upon the process variables such as development speed, writing voltage as well as upon the concentration of particles in the developer package. The range in optical density allows for color balancing of the cyan, yellow and magenta toners in order to faithfully reproduce secondary colors. In addition, the dyeing process described herein has the advantage of allowing for a controlled amount of dye to be deposited into the core of the particle. Furthermore since the dyes used are insoluble in the dispersion medium this technique eliminates background imaging by oil soluble dye. By contrast, the thermal imbibition technique suggested by U.S. Pat. No. 3,900,412 the amount of dye that enters the particles is uncontrolled and since the dye is soluble in the dispersion medium an unwanted background image is created.

While the invention has been described with particular reference to preferred embodiments and examples, it will be appreciated by the artisan that there are many modifications and alternatives that may be used without departing from the spirit and scope of the invention. For example, while the invention has been described essentially as being useful in the development of an image created in an electrostatic printing plotter, it should be understood that it has equal facility for use as a liquid developer in any electrostatographic type of reproduction system. It is intended that such modifications and alternatives together with others are part of the present invention when encompassed by the claims which follow.

What is claimed is:

1. A stable colored liquid developer comprising an insulating liquid dispersion medium having dispersed therein a marking particle comprising a thermoplastic resin core substantially insoluble in said dispersion medium, an amphipathic block or graft copolymeric steric stabilizer irreversibly chemically or physically anchored to said thermoplastic resin core, said steric stabilizer being soluble in said dispersion medium and a colored dye imbibed in the thermoplastic resin core, said dye being soluble in said thermoplastic resin core and insoluble in said dispersion medium.

2. The stable liquid developer according to claim 1, wherein said insulating liquid dispersion medium comprises an aliphatic hydrocarbon having a resistivity greater than about $10^9$ ohm cm.

3. The stable liquid developer according to claim 1, wherein said thermoplastic resin cores are substantially monodispersed particles having a diameter from about 0.1 micron to about 1.0 micron.

4. The stable liquid developer according to claim 1, wherein said colored dye is substantially insoluble in water, soluble in a polar solvent and substantially insoluble in the aliphatic dispersion medium.

5. The stable liquid developer according to claim 1, further including a charge control agent soluble in said liquid dispersion medium.

6. The stable liquid developer according to claim 1, wherein said core comprises a homopolymer of N-vinyl-2-pyrrolidone, vinyl acetate or ethyl acrylate monomer or a copolymer of said monomers.

7. The stable liquid developer of claim 1, wherein said amphipathic steric stabilizer comprises a graft copolymer which has a backbone portion soluble in said dispersion medium and a portion insoluble in said dispersion medium which has an affinity for the resin core.

8. The stable liquid developer of claim 1, wherein said soluble backbone portion is a poly(alkyl acrylate) or a poly(alkyl methacrylate), the alkyl group having at least three carbons.

9. The stable liquid developer of claim 8, wherein said amphipathic steric stabilizer is a graft copolymer of poly(2-ethylhexyl methacrylate) or poly(2-ethylhexyl acrylate) solution grafted with N-vinyl-2-pyrrolidone, vinyl acetate or ethyl acrylate.

10. The stable liquid developer of claim 1, wherein said dye is Orasol Blue GN, Orasol Blue 2GLN, Orasol Yellow 2GLN, Orasol Red G, Morfast Blue 100, Morfast Red 101, Morfast Red 104, Morfast Yellow 102, Savinyl Yellow RLS, Savinyl Black RLS, Savinyl Red 3 GLS or Savinyl Pink 6 BLS.

11. The stable liquid developer of claim 1, wherein said core is poly(vinyl acetate), poly(N-vinyl-2-pyrrolidone), poly(ethyl acrylate) or a copolymer of poly(ethyl acrylate-co-N-vinyl-2-pyrrolidone) and said steric stabilizer is a graft copolymer comprising a poly(2-ethylhexyl methacrylate), or poly(2-ethylhexyl acrylate) backbone with poly(N-vinyl-2-pyrrolidone), poly(ethyl acrylate), or poly(vinyl acetate) grafted onto it.

12. The method of making a stable colored liquid developer comprising providing a dispersion in an insulating dispersion medium of a marking particle comprising a thermoplastic resin core substantially insoluble in said dispersion medium, an amphipathic block or graft copolymer steric stabilizer irreversibly chemically or physically anchored to said resin core, said steric stabilizer being soluble in said dispersion medium;

adding to said dispersion medium a solution of a dye dissolved in a polar solvent, said dye being substantially insoluble in said dispersion medium and dispersible at the molecular level in said thermoplastic resin core to enable said dye to be imbibed in said thermoplastic resin, said thermoplastic resin being soluble in said polar solvent.

13. The method of making a stable colored liquid developer according to claim 12, wherein said polar solvent is methanol, glacial acetic acid, ethylene glycol, dimethyl sulfoxide, N,N dimethyl formamide and mixtures of these solvents.

14. The method of making a stable colored liquid developer according to claim 13, wherein said polar solvent is methanol.

15. The method of making a stable colored liquid developer according to claim 12, wherein said amphipathic steric stabilizer comprises a graft copolymer which has a backbone portion soluble in said dispersion medium and a portion insoluble in said dispersion medium which has an affinity for the resin core.

16. The method of making a stable colored liquid developer according to claim 15, wherein said soluble backbone portion is a poly(alkyl acrylate) or a poly(alkyl methacrylate) the alkyl group having at least three carbons.

17. The method of making a stable colored liquid developer according to claim 12, wherein said polar solvent is removed after said dye has been imbibed in said thermoplastic resin core.

18. The method of making a stable colored liquid developer according to claim 12, wherein said dispersion is provided by dispersing a polymer backbone in an aliphatic dispersion medium, in the presence of a free radical initiator, adding a monomer of vinyl acetate, vinyl pyrrolidone, or ethyl acrylate to said polymer to solution graft a homopolymer of one of said monomers or a copolymer of two of said monomers onto said polymer backbone thereby providing an amphipathic steric stabilizer for the subsequently formed polymer particles, in the presence of a free radical initiator adding an excess of vinyl acetate, vinyl pyrrolidone or 2-ethyl acrylate monomer or mixtures thereof to the solution of the amphipathic copolymer in the aliphatic dispersion medium to produce a homopolymer or copolymer core of the added monomer having irreversibly anchored thereto the steric stabilizer previously prepared.

19. The method of making a stable colored liquid developer according to claim 18, including the step of adding a charge control agent to the dispersion medium after the dye has been imbibed in said thermoplastic resin.

20. The method of making a stable colored liquid developer according to claim 12, wherein said dispersion is provided by preparing an amphipathic block or graft copolymer steric stabilizer in an aliphatic dispersion medium, adding to said stabilizer solution in the presence of a free radical initiator a monomer or mixture of monomers which when polymerized will provide a thermoplastic resin core insoluble in the dispersion medium, polymerizing said monomer or mixture of monomers in said aliphatic dispersion medium to provide a particle comprising a thermoplastic resin core substantially insoluble in said dispersion medium with the amphipathic steric stabilizer irreversibly chemically or physically anchored to said core.

21. The method of claim 18, wherein said colored dye is substantially insoluble in water and soluble in a polar solvent.

22. The method of claim 18, wherein said dye is Orasol Blue GN, Orasol Blue 2GLN, Orasol Yellow 2GLN, Orasol Red G, Morfast Blue 100, Morfast Red 101, Morfast Red 104, Morfast Yellow 102.

23. The method of claim 18, wherein said aliphatic hydrocarbon has a resistivity greater than about $10^9$ ohm cm.

24. The method of claim 18, wherein said thermoplastic resin cores are substantially monodispersed particles having a diameter from about 0.1 microns to about 1.0 microns.

25. The stable liquid developer according to claim 5, wherein said charge control agent is zirconuium octoate.

26. The method of making a stable colored liquid developer according to claim 19, wherein said charge control agent is zirconuium octoate.

* * * * *